United States Patent [19]

Cuomo et al.

[11] Patent Number: 4,633,129

[45] Date of Patent: Dec. 30, 1986

[54] HOLLOW CATHODE

[75] Inventors: Jerome J. Cuomo, Lake Lincolndale, N.Y.; Harold R. Kaufman, Fort Collins, Colo.; Stephen M. Rossnagel, White Plains, N.Y.

[73] Assignee: International Business Machines Corporation, Armonk, N.Y.

[21] Appl. No.: 729,028

[22] Filed: Apr. 30, 1985

[51] Int. Cl.[4] ..... H01J 43/08

[52] U.S. Cl. ..... 313/153; 313/103 CM; 313/339; 313/346 R

[58] Field of Search ..... 313/153, 103 CM, 356, 313/346 R, 336, 362.1, 313, 339

[56] References Cited

U.S. PATENT DOCUMENTS

| | | | |
|---|---|---|---|
| 3,320,475 | 5/1967 | Boring | 313/313 X |
| 3,414,702 | 12/1968 | Stauffer | 313/339 X |
| 3,515,932 | 6/1970 | King | 313/339 |
| 4,298,817 | 11/1981 | Carette et al. | 313/103 CM X |
| 4,325,000 | 4/1982 | Wolfe et al. | 313/346 R X |
| 4,377,773 | 3/1983 | Hershcovitch et al. | 313/362.1 X |

FOREIGN PATENT DOCUMENTS

| | | | |
|---|---|---|---|
| 26150 | 2/1977 | Japan | 313/103 CM |

*Primary Examiner*—Stewart J. Levy
*Assistant Examiner*—Joseph W. Roskos
*Attorney, Agent, or Firm*—Roy R. Schlemmer

[57] ABSTRACT

A long life high current density hollow cathode electron beam source for use in various E-beam apparatus which uses an ionizable gas within the hollow cathode. Bombardment of an electron emissive surface within the hollow cathode by energetic gas ions causes electrons to be emitted by secondary emission *rather than* thermionic emission effects. Once initialized by an external ionization voltage the device is essentially self sustaining and operates near room temperature, rather than at thermionic emission temperatures, and with reduced voltages.

9 Claims, 5 Drawing Figures

PRIOR ART
FIG. 1
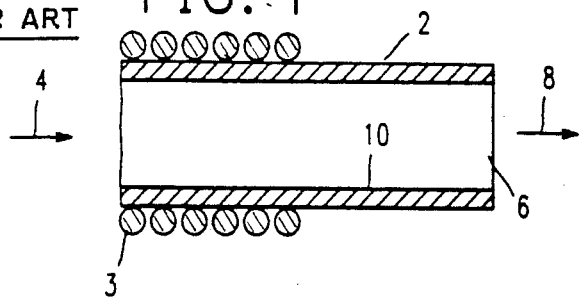
PRIOR ART
FIG. 2.1
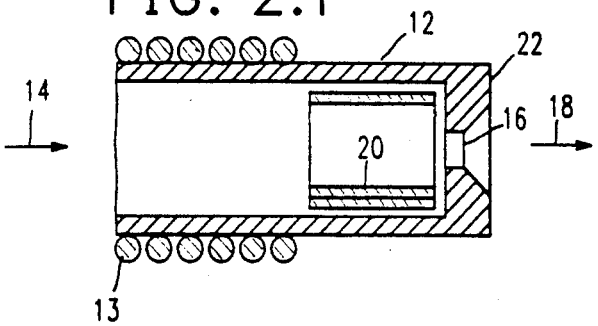
FIG. 2.2
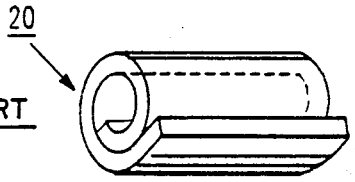
PRIOR ART

HOLLOW CATHODE

FIELD OF THE INVENTION

The hollow cathode is used to provide electron emission in a variety of devices. At the proper gas flow, the emitted electrons are accompanied by ions, resulting in a conducting plasma external of the cathode. Without this plasma the electron currents would be limited by space-charge considerations. With the presence of this plasma, high currents are possible at moderate voltages, for example tens or hundreds of Amperes at less than 100 volts.

The hollow cathodes of the prior art depend on thermionic emission for most of the current emitted. As a result, the emission surfaces must be hot. The high temperatures of these surfaces cause, either directly or indirectly, most of the shortcomings of prior art hollow cathode apparatus. By using secondary emission due to ion bombardment as the primary emission mechanism, the operation becomes substantially independent of the temperature of the emissive surface. If adequate cooling is provided, it is then possible to provide emission of large electron currents without the presence of hot surfaces.

PRIOR ART

U.S. Pat. No. 3,515,932 King, "Hollow Cathode Generator," discloses a structure based on the use of a low work function material, such as barium, strontium or calcium oxide, to reduce the work function of the inner surface of the hollow cathode. Reducing the work function allows electrons to be THERMIONICALLY emitted at lower temperatures than a higher work function material. The lower temperature in this case is in the 900C range. To attain this temperature, the hollow cathode tip must be heated by an external heater or a separate filament.

King describes a THERMIONIC process, in which electrons are emitted into the hollow cathode volume by high temperatures. The present invention uses no thermionic component, and simply operates from secondary electron processes. Thus, the disclosed structure is significantly different. As will be apparent from the subsequent description, the device of the present invention has a number of non-obvious advantages over the King cathode structure.

U.S. Pat. No. 3,320,475 Boring, "Non-thermionic Hollow Cathode Electron Beam Apparatus," discloses a very early generation plasma device with a hollow-shaped cathode. It operates at very high voltages (20000 V) and high discharge pressures (5–12 millitorr). It appears to be a simple variation of a DC glow discharge, and operates at very low currents (20 milliamps). This device differs from the present invention in a number of ways. It operates in much different pressure, voltage and current ranges, and does not really have a hollow cathode, merely a cylindrical-shaped cathode.

U.S. Pat. No. 4,325,000 Wolfe et al, "Low Work Function Cathode," comprises a field-emission device, in the shape of a tip, which is coated with a low work function material to allow thermionic emission of electrons at lower temperature. It is not a hollow cathode, nor does it use secondary electron effects, and thus is in no way related to the proposed invention.

U.S. Pat. No. 4,298,817 Carette et al, "Ion-Electron Source Channel Multiplier Having A Feedback Region," discloses a device which is based on an electron multiplier. An electron multiplier operates by having a very high voltage down the length of an almost-insulating tube or channel. Electrons in this channel are attracted by the positive potential, and hit the sides of the tube at high energy causing the formation of secondary electrons (formed from electrons). This patent has used this idea to create ions within this channel, or in some cases to produce elections. The device seems intended for use as an ion source, primarily.

The patent differs from the present invention in that it is a single particle device, not a plasma device as ours is. It operates with high electric fields (1–2000 V) and at relatively low currents. It uses as its primary process the production of secondary electrons from ELECTRONS, where our device uses secondary electrons from IONS.

U.S. Pat. No. 4,377,773 Herschovitch et al, "Negative Ion Source With Hollow Cathode Discharge Plasma," simply discloses an ion source with a hollow cathode electron source replacing the filament cathode. This is a straightforward application of hollow cathode technology, but uses a thermionic hollow cathode as the electron source. The difference again, with respect to the present invention, is the use of a non-thermionic, secondary electron-emission based hollow cathode.

A critical reading of each of the above patents found in the prior art search indicates that none of them disclose a secondary electron-based hollow cathode device such as that described herein.

In FIG. 1, which is typical of the prior art technology described above, the outer shell 2 is in the form of a tube. The ionizable gas 4 is introduced at one end of the tube, while the electron emission is from the aperture 6 at the other end. The emitted electrons leave in the general direction 8. Because the majority of the electron emission is thermionic in nature, it is necessary for the inside of the tube 10 near the aperture 6 to be close to thermionic temperatures. This may be achieved through the use of a thermionic heater coil 3 surrounding the hollow cathode. Because of secondary emission from ion collisions and the enhancement due to high electric fields, the emission is not completely thermionic. The bulk of the emission is thermionic in nature, however, because normal operation cannot be maintained without the emissive surfaces being close to the values required for thermionic emission. To be specific, the electron emission will drop sharply, while the extraction voltage increases, if these surfaces are allowed to cool.

The heating of the electron emissive surface 10 is accomplished by ion bombardment. During operation, the inside of the tube becomes filled with a plasma. This plasma is most dense near the aperture 6 through which the electrons are emitted. Much of the total operating voltage appears as a potential difference between this plasma and the tube 2. Ions leaving this plasma require an energy corresponding to this potential difference, resulting in a heating of the tube wherever they strike. Because the plasma is most dense near the aperture 6, the tube surface 10 near this aperture is heated most.

Operation is usually initiated with a high-voltage discharge to the end of the tube 2 near the aperture 6. As soon as the surface 10 is heated to operating temperature, the normal high-current, low-voltage discharge is established.

A variety of modifications have been made to conserve heat from the emissive surfaces and thereby reduce the required heating power. The technology developed for cathodes used in electric space propulsion is the most developed in this regard. Such a cathode, is indicated in FIG. 2.1.

In FIG. 2.1 there is again an outer tube 12, into one end of which flows an ionizable gas 14. The electron emission is through an orifice 16 at the opposite end. As in the device of FIG. 1 a thermionic heater 13 surrounds the tube 12 near the emissive element 20. The emitted electrons flow in the general direction 18. The electron emission in this case is from a barium and/or strontium oxide; $Al_2O_3$ or MgO cermet, which coats or impregnates an insert 20. The details of the element 20 are shown in greater detail in FIG. 2.2. Typically, this element would be constructed of several wrapped layers of foil material. Because thermionic emission takes place at a lower temperature with the presence of such an oxide, this insert operates at a lower temperature than the equivalent surface 10 in FIG. 1. Further, the insert 20 does not radiate directly to the surrounding space, but is shielded by the tube 12. The configuration of FIG. 2.1 therefore, has substantially reduced heating requirements, which result in the ability to operate at lower voltages for the same emission, as well as at lower emissions (both compared to the configuration indicated in FIG. 1).

As a further improvement of the configuration of FIG. 2.1, the emission orifice 16 is not the open end of a tube (aperture 6 in FIG. 1), but is in a plate 22 that covers the end of tube 12. This plate can be welded to tube 12, or only held in contact. Because of the reduced orifice area, compared to the open end of a tube, the gas flow required to maintain operating pressure within the cathode (typically of the order of 10 Torr, or 1300 Pascals) is reduced.

For the configuration of FIG. 2.1, a high-voltage discharge is also used to initiate operation. To reduce the power required in this discharge, though, the heating element 13 shown in the FIG. is wrapped around tube 12 as was the case in FIG. 1. Depending on the emission level required during normal operation, heating power may also be required after starting.

There are several shortcomings of prior art hollow cathode devices such as described in connection with FIGS. 1 and 2.1. In all cases the majority of emission is thermionic in nature, resulting in the need for a hot surface. This hot surface may be thermally undesirable, because of radiation to temperature-sensitive surfaces.

A more frequent problem is the presence of chemical reactions at the hot surfaces. It is, for example, frequently necessary to emit electrons in a nitrogen or oxygen environment (such as for the operation of a broad-beam ion source in these gases). But the refractory metals (typically tantalum and tungsten) used in the construction of hollow cathodes are attacked by nitrogen and oxygen at operating temperatures.

Another problem associated with the prior art apparatus has to do with extended electron sources. It is sometimes desirable to have an extended electron source so that electrons are added uniformly over a large area where high current deviation in the plasma is desired. Multiple apertures or a long slit aperture have been tried as a means to provide such an extended electron source with a single hollow cathode. For such an extended source, it is also necessary to have an extended electron-emission surface. But any nonuniformity in the temperature of an extended emission surface will result in a nonuniformity of emission. This nonuniformity of emission will, in turn, result in a nonuniformity of the plasma near the surface, inasmuch as the ions are produced by collisions of emitted electrons with neutral atoms. The nonuniformity in the plasma will then result in non-uniform bombardment of the electron-emission surface, which will increase the initial temperature difference. In this manner, electron emission will be restricted to only a small part of any extended electron-emission surface.

SUMMARY AND OBJECTS

It is a primary object of the present invention to provide a hollow cathode electron plasma source capable of operation at or near room temperature.

It is another object of the invention to provide such a hollow cathode apparatus capable of producing the desired electron plasma through secondary emission of electrons from a suitable surface within the hollow cathode chamber. It is still another object of the invention to provide such a hollow cathode apparatus which requires no high voltage operating voltages after initial start up.

It is another object to provide such a hollow cathode apparatus which is especially useful where the elevated operating temperatures usually associated with thermionic hollow cathode apparatus would be detrimental.

It is another object to provide such a hollow cathode apparatus wherein elongated emissive surfaces are possible due to non dependence on the inherently nonuniform thermionic emission mechanism.

These and other objects, features and advantages of the present invention are realized by a hollow cathode electron beam source utilizing an ionizable gas within the hollow cathode chamber and high voltage means for initializing ionization of said gas to cause the bombardment of an electron emissive surface within said chamber to produce emission of electrons from said emissive surface by the secondary emission mechanism, and means for removing the initialization voltage and maintaining a low voltage emission sustaining bias across said cathode whereby the electron emission is sustained by secondary emission effects and the device is capable of operating at room temperature.

DESCRIPTION OF THE DRAWINGS

FIG. 1 comprises a cross sectional view of a simplified prior art hollow cathode.

FIG. 2.1 comprises a cross sectional view of a somewhat more sophisticated thermionic hollow cathode as found in the prior art.

FIG. 2.2 comprises a perspective view of the emissive element shown in the device of FIG. 2.1.

DESCRIPTION OF THE INVENTION

Figure 3:
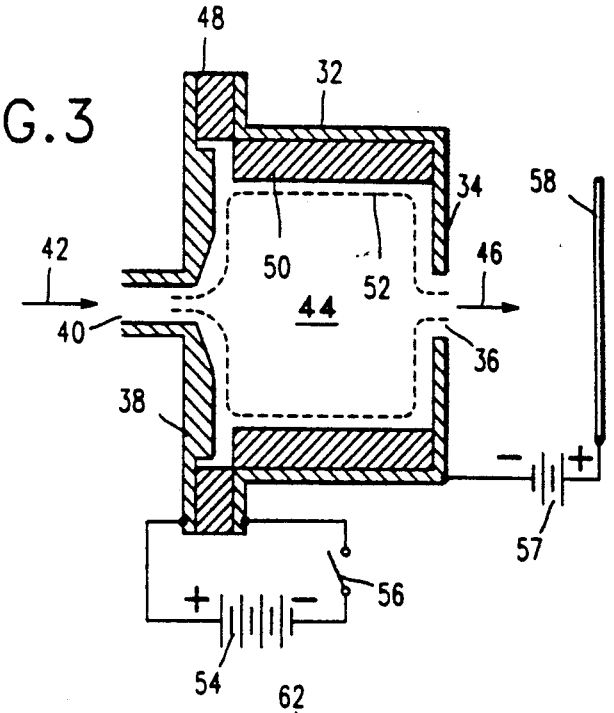
FIG. 3 comprises a combination cross sectional view and functional schematic diagram of a hollow cathode apparatus constructed in accordance with the teachings of the present invention.

The present invention can be best understood by reference to the fragmentary schematic diagram of FIG. 3. There is an outer enclosure 32, at one end of which there is a wall 34, with the wall having an aperture 36 for electron emission. At the opposite end of enclosure 32 is another wall 38, with this wall having a port 40 for the admission of an ionizable gas 42. The enclosure 32 and walls 34 and 38 define an interior volume 44. During operation, the volume 44 is filled with a plasma and electrons are emitted through aperture 36 to flow in the general direction 46.

For starting, (i.e., to provide the initial discharge formation) an external high-voltage discharge can be used. Alternatively one part of the enclosure can be electrically isolated from the rest. In this case wall 38 is isolated from enclosure 32 by insulator 48. The electrode shape (wall 38 in this case) near the insulator is contoured so as to prevent a direct view of the insulator by the discharge and the ion bombarded surfaces. In this manner, the buildup of a conductive coating on the insulator is inhibited.

For starting, then, wall 38 is made positive with respect to enclosure 32 and wall 34, typically by several hundred volts. This is shown in FIG. 3 by voltage source 54 and a switch 56. The ions formed in the resulting discharge bombard the electron emissive surface 50, thereby emitting electrons to sustain the discharge. Most of the volume 44 becomes filled with a conducting plasma. Electron emission from this plasma, through aperture 36, serves to establish electrical contact to one or more external anodes, (e.g., 58 in the FIG.). With currents to these anodes established, the voltage applied to wall 38 can be removed and normal operation continued by, for example, opening switch 56.

For normal operation, a potential difference of the order of 200 volts must be established between the plasma in volume 44 and the emitting surface 50. The potential is established by the voltage source 57 connected between the wall 32 of the hollow cathode structure and the anode 58. The plasma in volume 44 is dense, so that most of this potential difference appears across a plasma sheath, between the sheath boundary 52 and the surface 50. The electrons emitted from surface 50 are directed normal from the surface, to collide with neutral atoms or molecules in volume 44. Because of the energy of these electrons, a number of collisions are required to slow the electrons to an energy of one to several eV. The shape and location of emitting surface 50 is chosen so that electrons accelerated through the sheath are not directed through aperture 36, but must have collisions before escaping. Further, some secondary electrons are emitted from other surfaces, for example wall 38. In this case the inside surface of wall 38 is contoured so as to minimize the number of emitted electrons that are directed through aperture 36.

To assure efficient operation of the hollow cathode of FIG. 3, the emission of secondary electrons by the emissive surface 50 should be enhanced. This enhancement is accomplished by the use of light gas ions and the proper compound for the surface 50, as described in secondary-emission surveys.

Typical gases for efficient operation are hydrogen, helium and neon. Mixtures of these gases with other reactive gases, such as $N_2$ or $O_2$, may be appropriate for inducing certain chemical reactions, such as the formation of an oxide, to sustain a high seconding electron yield surface. For the emissive surface, oxides and halides are typical compounds. Useful high secondary emission electron surfaces include MgO, $MgF_2$ $Al_2O_3$ BaOSrO, NaCl, ZnS and combinations of these and other oxides and halides. Secondary emission characteristics have not been found for aluminum and magnesium oxides, but these would also be expected to be suitable compounds. Because such compounds are usually insulators, it will sometimes be desirable to use these compounds as sintered mixtures of inert conductor and insulating compounds. Alternatively, it may be adequate to form a thin surface layer of the desired compound on the inside surface of enclosure 32 by making the enclosure of the proper material and having a small fraction of the reacting gas present. For example, the enclosure could be of magnesium and a small amount of oxygen could be present, either in the working gas introduced through port 40 or as backflow from the surrounding volume through aperture 36.

It should be noted that, while heating will result from collisions of the ions with the emissive surface 50, this emissive surface need not be at a high temperature for satisfactory operation. Accordingly, if radiation losses are not sufficient to maintain a low surface temperature, tubes with an internal flow of a cooling liquid could be attached to enclosure 32.

With low surface temperatures, reaction rates of reactive gases will be reduced. Also, with no high temperature requirement, materials can be selected for corrosion resistance rather than temperature capability. Extended operation with reactive gases would therefore be possible.

Figure 4:
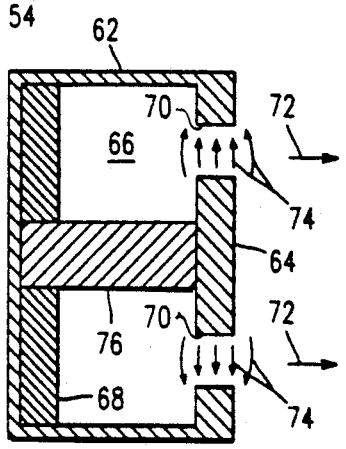
FIG. 4 comprises a cross sectional view of an alternative embodiment of the hollow cathode apparatus shown in FIG. 3.

With thermionic emission not an important factor, extended emissive surfaces should operate with either an extended aperture or multiple apertures, to provide an extended electron source. An alternate embodiment of the proposed invention can best be understood by reference to the partial sectional view of FIG. 4. There is an outer enclosure 62. This outer enclosure, together with pole piece 64 define an enclosed volume 66. The electrons generated by ion collisions with emissive surface 68 escape through aperture 70 in the general direction 72.

This embodiment of the invention is suited for low-pressure operation, such that most or all of the neutral gas in volume 66 results from the backflow of gas from the surrounding volume through aperture 70. With the gas supplied by this backflow, it will generally have a low density. The plasma generated within volume 66 will therefore also have a low density. As a result, a large aperture area will be required to permit the escape of a significant electron current. This large aperture area would ordinarily permit the escape of a large number of energetic electrons, except for magnetic field lines 74, which are generated by permanent magnet 76. The magnetic field is concentrated in the aperture 70 by constructing the enclosure 62 and the pole piece 64 of magnetically permeable material. The magnitude and extent of the magnetic field is selected (in accordance with the magnetic integral approach) so that energetic electrons are contained within volume 66, rather than escaping through aperture 70. This containment results in the escaping electrons having only moderate energy, rather than a large fraction with high energy. The containment of energetic electrons also enhances secondary electron emission by increasing the local generation of ions, which, in turn, bombard the emissive surface 68.

CONCLUSIONS

The primary advantage of the present invention resides in its ability to operate at low temperature. The specific advantages of low temperature operation include: reduced radiation to temperature-sensitive components; reduced sensitivity of the cathode to reactive gases; and enhanced ability to operate spatially extended electron sources.

The invention takes advantage of the previously known but troublesome problem in such electron emissive plasma systems merely secondary emission which was normally suppressed. By properly selecting conducting high secondary emissive surfaces, operative ion-bombardment induced secondary electron emissive hollow cathode devices have been constructed having the characteristics described above.

Having thus described our invention, what we claim as new and desire to secure by Letters Patent is:

1. In an electron beam apparatus, the improvement which comprises a hollow cathode structure comprising an outer enclosure, having at one end thereof a wall, said wall having an aperture therethrough for electron beam emission, a second wall at the opposite end of said enclosure, the enclosure and walls defining an interior chamber, means for admitting an ionizable gas into said chamber, the interior surface of said chamber, exclusive of said end walls, having a low work function electron emissive coating thereon which readily emits electrons under bombardment by ions from said gas, and means for ionizing the gas within said chamber whereby high energy electrons are emitted from said surface by secondary emission effects and low energy electrons released by collision between said high energy electrons and gas ions are emitted through the aperture.

2. An electron beam apparatus as set forth in claim 1, further including means for initiating operation of the device including a(n external) high-voltage discharge for initially ionizing the gas within the said chamber whereby the gas ions collide with said electron emitting surface to release high energy electrons therefrom, said high energy electrons in turn colliding with gas molecules within said chamber to, in effect, sustain the ionized condition of said gas even after the initial high voltage is removed.

3. An electron beam apparatus as set forth in claim 2 wherein the ionizable gas is selected from the group consisting of hydrogen, helium, Ne and combinations of these and reactive gases including $O_2$, $N_2$ and Ar.

4. An electron been apparatus as set forth in claim 3 wherein the electron emissive surface is comprised of a layer of a material selected from the group consisting of oxides and halides including MgO, $MgF_2$, NaCl, ZnO, $Al_2O_3$, $SiO_2$, BaOSrO and combinations of these and other oxides and halides.

5. An electron beam apparatus as set forth in claim 2 wherein the secondary electron emissive surface is located on those surfaces of said chamber which produce high energy electrons leaving said surfaces in a direction substantially normal to the electron beam emanating from said hollow cathode structure.

6. In a electron beam apparatus, the improvement which comprises a hollow cathode structure comprising an outer enclosure, having at one end thereof a wall, said wall having an aperture therethrough for electron beam emission, a second wall at the opposite end of said enclosure, means for admitting an ionizable gas into said chamber, the enclosure and walls defining an interior chamber, at best, some of the interior surfaces of said chamber having a low work function secondary electron emissive coating thereon which readily emits electrons under bombardment by ions from said gas, means for admitting an ionizable gas plasma into said interior chamber, and means for establishing a strong magnetic field transverse to electron beam flow through said aperture in said one end wall whereby energetic electrons are substantially prohibited from passing through said aperture.

7. An electron beam apparatus as set forth in claim 6 wherein said magnetic field establishing means comprises a pole piece located within said aperature defining an opening for ionized gas and electron flow between itself and the walls of said aperature and means for supplying a strong magnetic field to said pole piece.

8. An electron beam apparatus as set forth in claim 7 wherein said means for supplying a strong magnetic field comprises a permanent magnet located within said hollow cathode internal chamber and attached to provide a low permeability path to said pole piece at one end and to the structure defining said hollow cathode at the other.

9. An electron beam apparatus as set forth in claim 6, further including means for initiating operation of the device including a high-voltage discharge for initially ionizing the gas within the said chamber whereby the gas ions collide with said electron emitting surface to release high energy electrons therefrom, said high energy electrons in turn colliding with gas molecules within said chamber to, in effect, sustain the ionized condition of said gas even after the initial high voltage is removed.

* * * * *